US007770737B2

(12) United States Patent
Fennekotter et al.

(10) Patent No.: US 7,770,737 B2
(45) Date of Patent: Aug. 10, 2010

(54) SCREENING MACHINE

(75) Inventors: Klaus Fennekotter, Munster (DE); Rudiger Heinrich, Fenwick (CA); Dieter Takev, Saint Catharines (CA); Hubert Schulze Eistrup, Nottuln (DE)

(73) Assignee: Haver & Boecker OHG, Oelde (DE)

( * ) Notice: Subject to any disclaimer, the term of this patent is extended or adjusted under 35 U.S.C. 154(b) by 129 days.

(21) Appl. No.: 12/014,538

(22) Filed: Jan. 15, 2008

(65) Prior Publication Data

US 2008/0169224 A1 Jul. 17, 2008

(30) Foreign Application Priority Data

Jan. 17, 2007 (DE) ..... 10 2007 003 360

(51) Int. Cl.
*B07B 1/49* (2006.01)

(52) U.S. Cl. ..... 209/405; 209/404; 209/412

(58) Field of Classification Search ..... 209/404, 209/405, 412
See application file for complete search history.

(56) References Cited

U.S. PATENT DOCUMENTS

| | | | | | |
|---|---|---|---|---|---|
| 2,345,947 | A | | 4/1944 | Parks | |
| 3,101,314 | A | * | 8/1963 | Johnson | 209/319 |
| 4,040,951 | A | | 8/1977 | Cole | |
| 4,582,597 | A | * | 4/1986 | Huber | 209/313 |
| 4,732,670 | A | * | 3/1988 | Nelson | 209/314 |
| 4,840,728 | A | * | 6/1989 | Connolly et al. | 209/405 |
| 5,112,475 | A | * | 5/1992 | Henry, Jr. | 209/399 |
| 5,385,242 | A | * | 1/1995 | Freissle | 209/399 |
| 5,398,817 | A | * | 3/1995 | Connolly et al. | 209/399 |
| 5,615,776 | A | * | 4/1997 | Bjorklund et al. | 209/403 |
| 2008/0169224 | A1 | * | 7/2008 | Fennekotter et al. | 209/405 |

FOREIGN PATENT DOCUMENTS

| | | |
|---|---|---|
| DE | 33 90 381 C2 | 9/1992 |
| EP | 0 699 839 A1 | 3/1996 |
| GB | 1 578 946 A | 9/1977 |
| WO | 84 02290 | 6/1984 |

* cited by examiner

*Primary Examiner*—Gene Crawford
*Assistant Examiner*—Terrell H Matthews
(74) *Attorney, Agent, or Firm*—Pearne & Gordon LLP

(57) ABSTRACT

A screening machine for screening bulk material and the like comprising a housing and two sidewalls at which a screen deck is disposed, the screen deck comprising cross-members mounted on the sidewalls and longitudinal members which are mounted on the cross-members and receive an exchangeable screen lining. Said longitudinal members are clamped to the cross-members by means of removable mounting ties from two different directions.

18 Claims, 4 Drawing Sheets

SCREENING MACHINE

Figure 1:
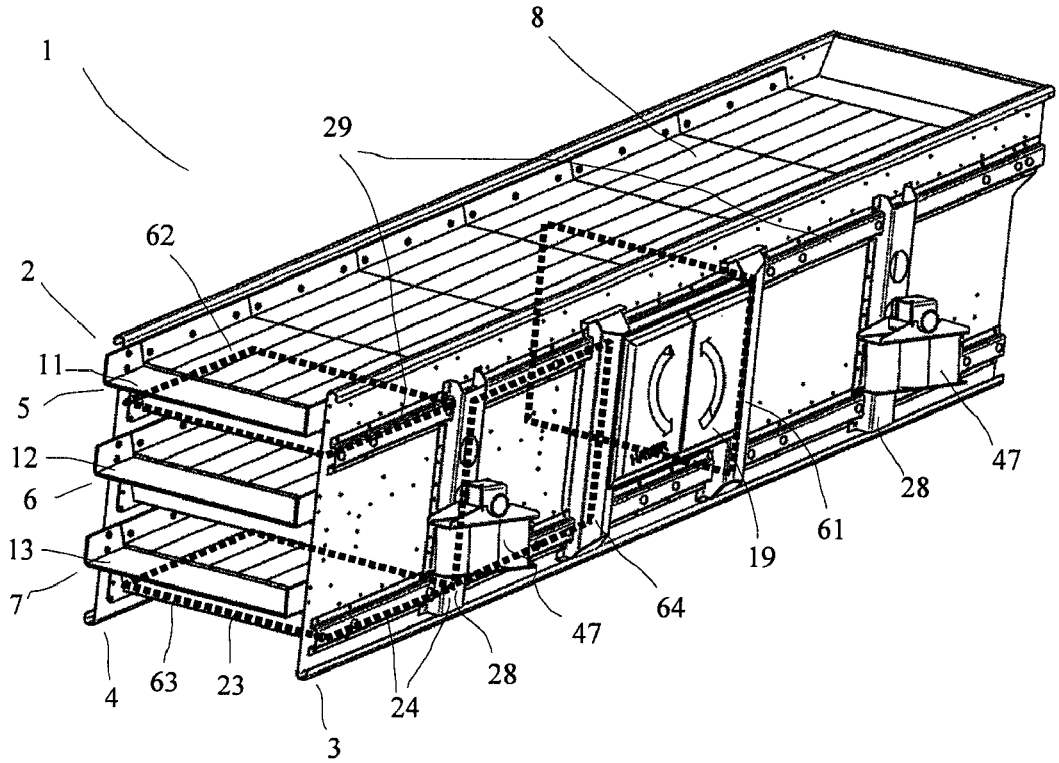

The present invention relates to a screening machine, in particular an oscillating or vibrating screening machine provided for grading, screening, and draining bulk material and the like.

In the prior art, a vibrating screening machine has become known which comprises a housing having two sidewalls with one or more screen decks disposed therebetween. A screen deck is supported by way of the cross-members or movable bars onto which longitudinal members are welded which support the actual screen panel. To secure the longitudinal members to the cross-members, support angles are usually welded to the cross-members onto which the longitudinal members are then welded.

In vibrating screening machines the cross-members are placed under very large stresses such that, considerable wall thickness notwithstanding, the cross-members tend to fracture or break after some operating time which leads to not insignificant downtime of the machine and corresponding repairs. The prior art has therefore enlarged the dimensions of the cross-members to thus reduce downtime.

One drawback of welded connections between the longitudinal members and the cross-members is that the cross-members are weakened locally at the weld seams and thus become prone to fracture.

From U.S. Pat. No. 4,840,728, a vibrating screening apparatus has become known where the longitudinal members are bolted to the cylindrical cross-members by means of U-bolts to avoid stresses caused by weld seams.

One drawback of said known vibrating screening machine is, however, that the rigidity of said cylindrical cross-members is small for the stresses occurring, such that thick-walled cross-members need to be employed which increase the total weight of the vibrating machine. There is another drawback in that the clamping bolts are clamped to the cross-members in one direction only due to the tensile stresses such that the continuous vibrations occurring in service may lead to a transverse displacement of the mounting clamps which in turn results in indeterminate stress conditions or soiling.

In view of the cited prior art it is therefore the object of the present invention to provide a screening machine which enables the longitudinal members to be reliably retained to the cross-members and which allows a relatively low weight of the cross-members while offering a long service life.

Said object is solved by an apparatus having the features of claim 1. Preferred embodiments are the subjects of the subclaims.

The screening machine according to the invention is in particular provided for screening bulk material and the like. The screening machine comprises a housing and at least two sidewalls on which at least one screen deck is disposed. The screen deck comprises cross-members mounted to the sidewalls and longitudinal members mounted to the cross-members, which receive a screen lining so as to be replaceable or exchangeable. The longitudinal members are clamped to the cross-members by means of removable mounting ties. Said mounting ties are clamped to the cross-members from two directions to ensure a secure seat of the longitudinal members on the cross-members even in continuous operation of a vibrating screening machine.

The screening machine according to the invention has many advantages. The screening machine according to the invention achieves a reduction in the total weight while concurrently reducing the failure rate of the cross-members. The clamping of the longitudinal members according to the invention by means of the mounting ties achieves a firm connection between the longitudinal and the cross-members while avoiding increased thermal stresses on the cross-member material which would be caused by welding. Although connection occurs by clamping, the mounting achieved is reliable and durable since clamping is employed from two different directions.

In a preferred embodiment of the invention the mounting tie is mounted around and clamping the cross-member, comprising two connecting means, one counterpanel and one retaining panel with which the screen lining is connected. The counterpanel may be integrally manufactured or connected with a connector. The retaining panel has the longitudinal member—indirectly or directly—securely and detachably mounted to it.

Preferably at least one and in particular substantially all of the cross-members of the screening machine according to the invention are substantially rectangular in cross-section. A cross-member comprises a bottom face, two side faces, and a top face. The cross-member is preferably larger in height than in width to thus achieve increased rigidity in the vertical direction. The vertical direction is the direction in which particularly high loads are imposed by the material to be screened or graded falling back down on the screen lining.

Preferably the counterpanel of the mounting tie is pressed against a bottom face of the cross-member to generate clamping to the cross-member in one direction.

Preferably one mounting tie comprises at least one clamp to ensure clamping to the cross-member. The clamp in particular generates a clamping contact of the mounting tie to a side face or front or rear face of the cross-member.

The clamp in particular serves for two-dimensional clamping namely for one, vertical clamping in that the counterpanel is pressed against the bottom face of the cross-member and the retaining panel is pressed against the top face of the cross-member, and for another, horizontal clamping wherein the clamp is pressed against a side face of the cross-member to establish a particularly firm connection.

Preferably the clamp comprises two mating clamping parts provided with inclined slideways.

The connecting means of the mounting tie are preferably configured hollow, serving to guide mounting bolts whose heads abut the counterpanel and whose threaded portions extend through the hollow connecting means and the bores in the retaining panel. On the top surface of the retaining panel the protruding threads of the mounting bolts are provided with nuts and the mounting tie is attached to the cross-member.

Between a connecting means and the retaining panel there is preferably provided the clamp which comprises two mating clamping parts provided with inclined slideways. Through the center of the clamping parts of the clamp the mounting bolt extends in such a way that as said mounting bolt is screwed on, the two clamping parts of the clamp are displaced against one another on the inclined clamping surfaces wherein one clamping part is pressed against the side face of the cross-member. In tightening the mounting bolt, the clamp causes one of the mounting legs to be adjusted in length and clamped in the vertical direction, and furthermore a clamping in the horizontal direction of the mounting tie to the cross-member.

All of the embodiments preferably provide for the lateral distance between two different mounting ties on one cross-member to be adjustable. Preferably a mounting tie can be clamped on a cross-member in virtually any desired position. This allows to employ different screen modules for the screen lining. The lateral distance may for example be set to a width of 30 cm. Where required, the distance may be changed from 30 cm e.g. to 12 inch to employ systems from the imperial or Anglo-Saxon system of measures.

In this way it is possible to offer machines having the same dimensions for Anglo-Saxon or American and continental European regions. Not until the mounting ties are mounted will their lateral distances be determined.

Concurrently it is permitted to fasten a wear protection device to a cross-member between two mounting ties to protect the cross-member from knocks and shocks by the material screened.

Preferably at least one mounting tie or at least one connecting means has disposed on it a mounting profile to which in turn at least one add-on part can be attached. The mounting profile is in particular configured such that the add-on part can be clamped to the mounting profile.

It is particularly preferred for at least one add-on part to be a wear protection device to protect e.g. the cross-member.

Such a configuration offers fairly considerable advantages. To extend the service life of the cross-members of the screening machine, they should be protected from knocks, shocks, and abrasion from material being graded which may get through the screen lining and may fall onto or graze the cross-members. If the cross-members have mounting means welded thereon for receiving wear protection elements, the structure of the cross-members will be weakened. Therefore it is very advantageous to dispose wear protection elements on the mounting profile in particular with the wear protection elements clamped to the mounting profiles because exchange will be facilitated then.

The mounting profiles in particular serve as wear protectors to the bolts when configured hollow inside so as to centrally receive the thread at the mounting profile.

Preferred specific embodiments provide for the counterpanel to support the mounting profile from beneath. The counterpanel in particular at least prevents the wear protector protecting the side faces of the cross-member from sliding off. To this end the counterpanel may comprise side shoulders as a support for the lateral, in particular panel-type, wear protector.

Preferably at least one add-on part may be mounted to the retaining panel. At least one add-on part is in particular a wear protection device configured in particular as an upper wear protection device for the top surface of the cross-member. An approximately plate-shaped upper wear protection device in particular comprises side protection elements extending downwardly on the sides to ensure an overlap of the upper wear protection device and the side wear protection devices such that no bulk material can enter the space between the upper and the side wear protection devices.

In all of the embodiments the screening machine according to the invention is in particular configured such that the connecting points of the cross-members with the sidewalls are arranged in a grid having defined grid dimensions. This allows to achieve a flexible and variably expandable structure of the screening machine of the invention.

Figure 2:
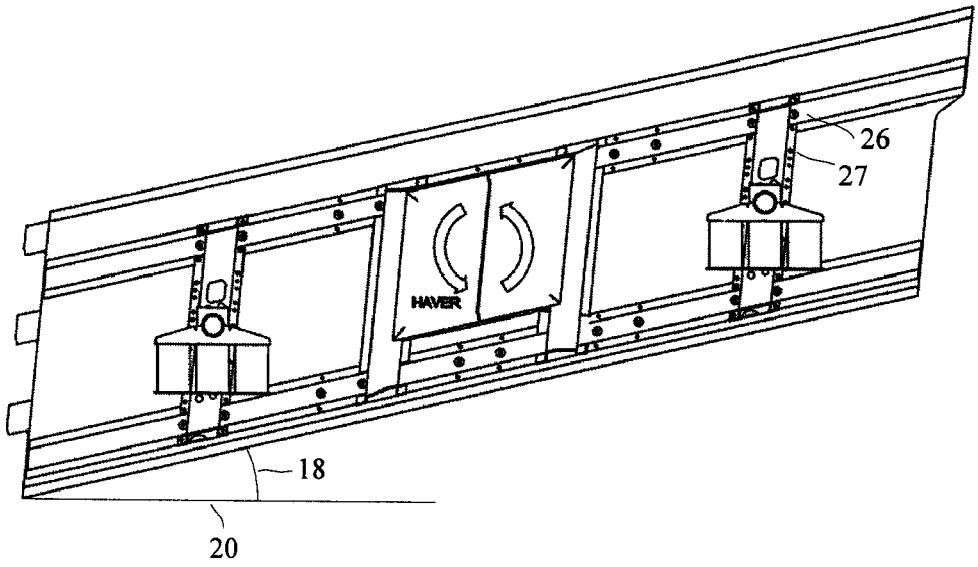
Figure 3:
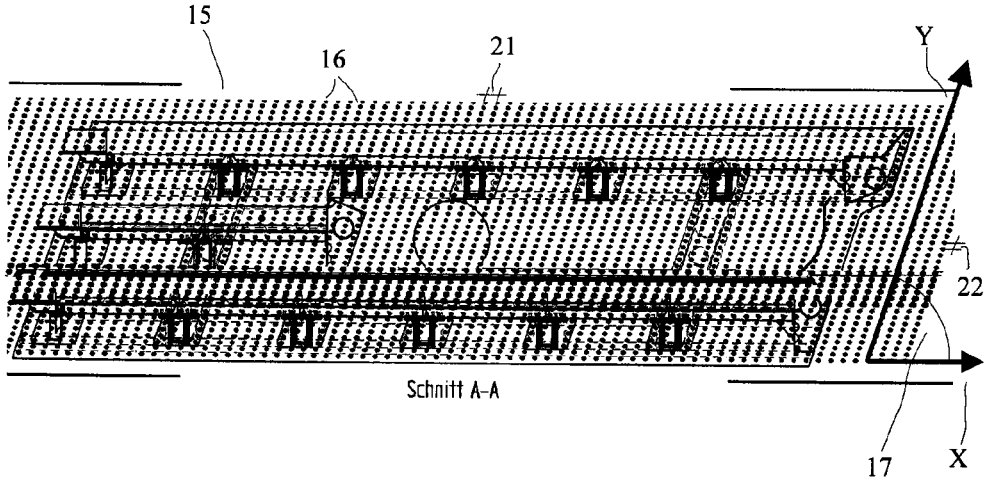
Figure 4:
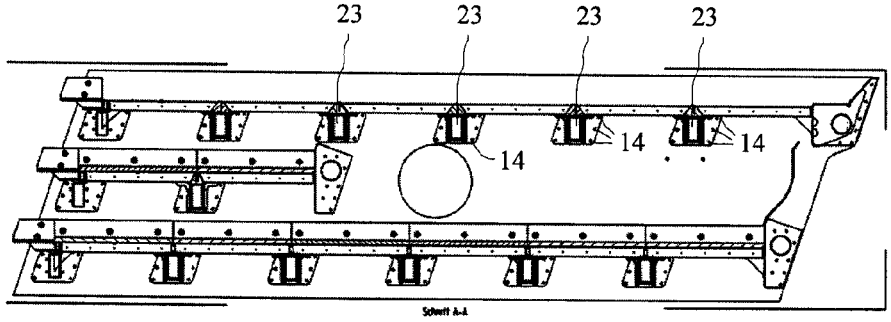
Figure 5:
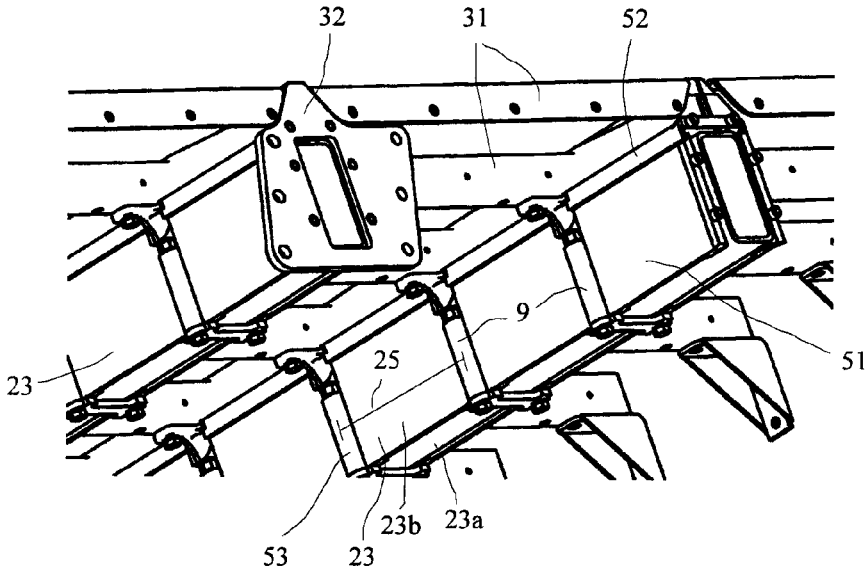
Figure 6:
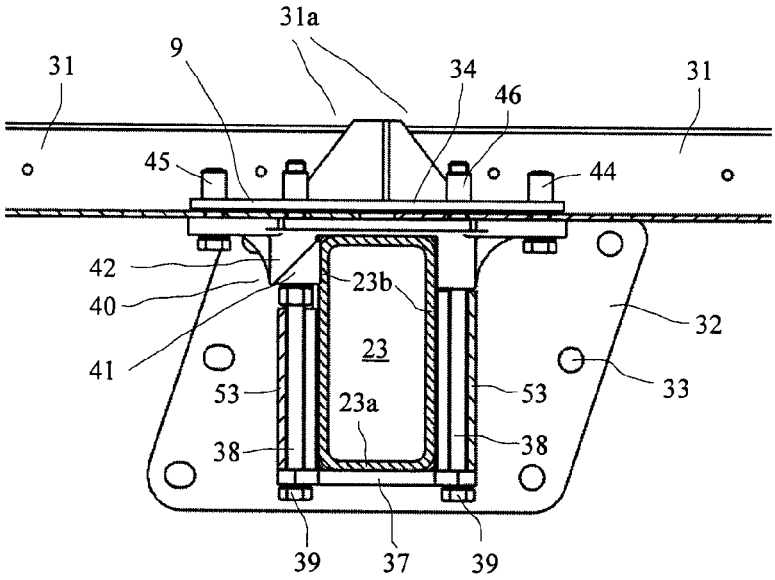
Figure 7:
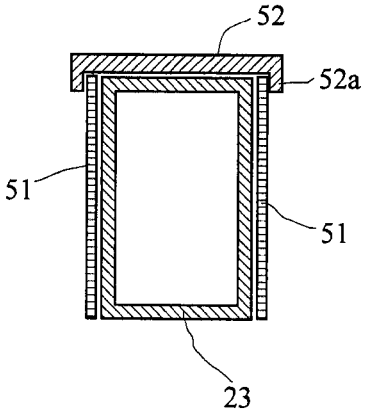
Figure 8:
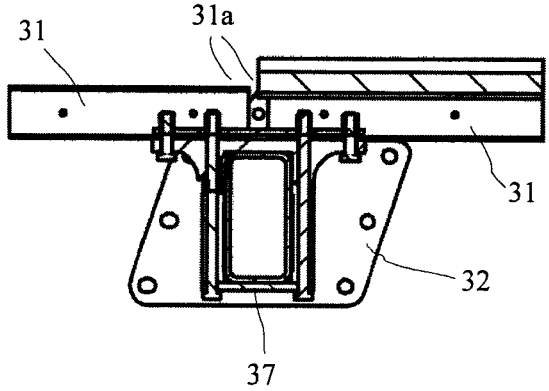
Figure 9:
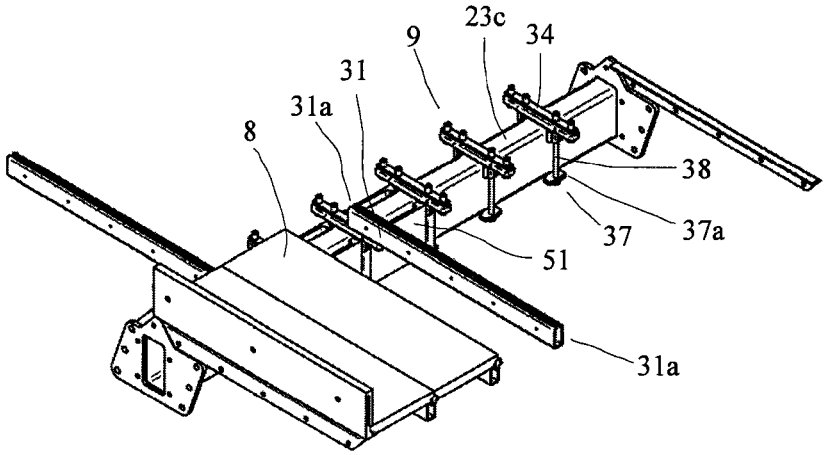
Figure 10:
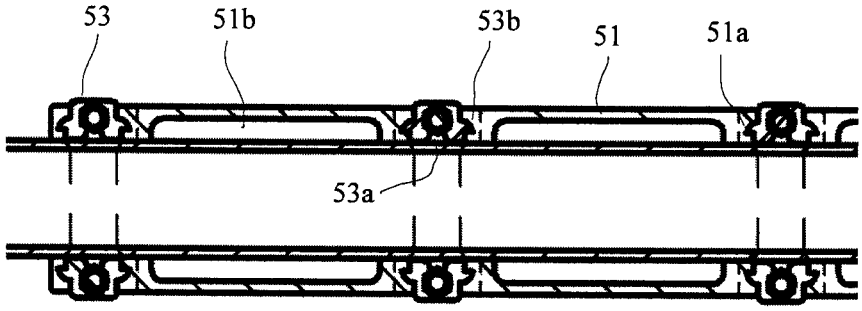

Further advantages and applications can be taken from the exemplary embodiment described below with reference to the enclosed Figures:

These show in:

FIG. 1 a schematic, perspective view of an inventive vibrating screening machine;

FIG. 2 a schematic view of a sidewall of the vibrating screening machine according to FIG. 1;

FIG. 3 a schematic side view of the sidewall with the grid inserted;

FIG. 4 a partially cutaway side view of the vibrating screening machine according to FIG. 1;

FIG. 5 a perspective bottom view of a screening deck with the sidewall removed;

FIG. 6 a side view of a mounting tie for the longitudinal members for a vibrating screening machine according to FIG. 1;

FIG. 7 a simplistic, vertical cross-section of a cross-member;

FIG. 8 another schematic cross-section of a cross-member showing a reinforcement unit;

FIG. 9 a schematic, perspective top view of a machine section with a cross-member; and FIG. 10 a schematic, horizontal cross-section of a cross-member.

With reference to the FIGS. 1 to 10, an embodiment of the present invention will now be described. FIG. 1 illustrates a total view of a screening machine 1 according to the invention configured as a vibrating screening machine.

Although the screening machine 1 in the present exemplary embodiment is in particular employed for grading bulk material such as gravel, split gravel, pebbles, sand, construction waste or limestone, it may be intended or serve for screening or grading other bulk materials.

The screening machine 1 comprises a housing 2 having sidewalls 3 and 4, with three screen decks 5, 6 and 7 disposed in between in the present example. The screen lining 8 of a screen deck may be configured as a tensioned wire mesh or as a perforated plate having holes that e.g. widen conically downwardly or in particular as a rubber or plastic lining in which holes are provided according to the appropriate grading specifications.

At what is the rear end of the screening machine 1 in the perspective illustration of FIG. 1, a material feed 10 is provided for feeding the bulk material to be graded to the screening machine. The graded bulk material, in relation to the fineness of grains, reaches the screen deck 6 or 7 or falls all the way down or remains on the screen deck 5 until it is carried off via the respective fine grain discharge 12 or 13 or the coarse grain discharge 11.

The present screening machine 1 is configured as a circular flexible-drive screening machine, comprising a drive 19 and four elastic support systems 47 to bear the screening machine 1 relative to the floor.

The sidewalls 3 and 4 are provided with horizontal and vertical reinforcing units 29 and 28 respectively which are configured as chamfered metal profiles.

The reinforcing units 28, 29, which are approximately rectangular in cross-section, are formed by the curved metal sheets on three sides and on one side by the sidewalls 3 and 4 respectively of the screening machine 1, thus considerably increasing the rigidity of the sidewalls such that the sidewalls do not require extensive doubling in loaded areas such that while the total weight of the screening machine and the amount of material required is reduced, the reinforcing effect is still enhanced.

The reinforcing units 28, 29 combined with the cross-members and the sidewalls form reinforcing frames wherein just a few reinforcing frames 61 to 64 are indicated by bold dotted lines in FIG. 1 by way of example.

The reinforcing frame 61 is formed by two vertical reinforcing units 28 and by the three horizontal cross-members 23 which in this longitudinal position hold the three screen decks 5, 6 and 7. The vertical reinforcing frame 61 and the other vertical reinforcing frames of the other vertical reinforcing units 28 result in an outstanding vibratory rigidity of the structure of the screening machine 1.

Longitudinal reinforcing frames 62 and 63 are formed by the horizontal or longitudinal reinforcing units 29 and the cross-members 23 associated with the screen deck 5 or 7 respectively. Further longitudinal reinforcing frames are formed by the further longitudinal reinforcing units 29 and the associated cross-members 23 such that in this plane high rigidity is again achieved.

In the third dimension, side reinforcing frames are formed of which the side reinforcing frame 64 is indicated by way of example as a bold dotted line.

The reinforcing frames 61 through 64 provided in all of the three dimensions result in a considerably increased vibratory rigidity of the screening machine 1 while providing only a moderate weight increase.

Another contributive factor is that individual screwed connections attach both the cross-member and a reinforcing unit to the sidewall to thus achieve an optimal connection.

When assembled as intended, the screen of the screening machine is inclined at an angle 18 which in the present embodiment is between approximately 10 and 30 degrees.

All of the mounting points 14 on the sidewall 3 and the sidewall 4 are aligned with a grid 15 which is provided with grid points 16.

The grid points are aligned with an x-y-coordinate system with the x-coordinate x presently aligned parallel to the bottom and top edges of the sidewalls 3 and 4 respectively. While the grid distance 21 between two grid points in the x-direction may equal the grid distance 22 in the y-direction, it may be independent of the grid distance 22 in the x-direction.

The y-coordinate is positioned relative to the x-coordinate at a system angle 17 which in the present exemplary embodiment is between approximately 60 and 80 degrees. Thus the x-y-coordinate system is not rectangular but has angles offset from 90 degrees by approximately 10 to 30 degrees.

In the present embodiment all of the mounting points 14 are selected with reference to the grid points 16, wherein reference is made to the fact that said grid points 16 may be virtual points such that not every grid point 16 illustrated in FIG. 3 needs to be visible on the sidewalls 3 and 4 of the screening machine.

In the screening machine 1 all of the mounting points 14 for mounting the cross-members 23 to the sidewalls 3, 4 are so aligned with the grid that the axial distance of specific mounting points on a cross-member 23 equals a multiple of the grid distance.

The distance in the x- or y-direction of a mounting point 14 of a cross-member 23 from a mounting point 14 of another cross-member 23 likewise equals a multiple of the grid distance so as to result in a modular and systematic structure of the machine which permits simple adaptation of other modules because a large variety of modules may be added on independently of the machine size.

FIG. 5 shows a perspective bottom view of two cross-members 23 with the sidewall 3 cut away. The cross-members 23 are attached to the sidewall 3 by means of flanges 32. The cross-members 23 are provided with mounting ties 9 at suitable lateral distances 25 to securely but removably connect the longitudinal members 31 with the cross-members 23.

The screwed connections of the longitudinal members 31 with the cross-members 23 prevent weld stresses so as to increase reliability and durability while employing a uniform wall thickness in the cross-members 23.

The way of attaching a mounting tie 9 to a cross-member 23 is shown in FIG. 6 in an enlarged section view. The counterplate 37 is pressed against the bottom face 23*a* of the cross-member 23 by way of the clamping force of the bolts 38. The bolt heads 39 of the bolts 38 abut the bottom face of the counterplate 37 while the threaded portions extend upwardly where they pass through bores in the retaining panel 34 and mounted on the top surface by means of nuts 46. Protectors may be provided to shield the threaded ends and the nuts 46 against damage from any graded material falling down.

The bolts 38 may be provided with mounting profiles 53 which in turn can receive wear protection elements.

Between the connecting means configured as a mounting bolt 38 and the lower edge of the retaining panel 34 a clamp 40 is provided comprising clamping parts 41 and 42 designed wedge-like with the inclined faces gliding upon one another. In the present embodiment the clamping part 42 is formed integrally with the retaining panel 34.

The mounting bolt 38 extends through an axial hole in the clamp 40 such that as the bolt 38 is tightened, the clamping part 41 moves axially in the direction of the retaining panel 34 such that the mounting part 41 is pressed against a side face 23*b* of the cross-member 23. In this way the clamping pressure achieved will be twofold wherein for one, the counterpanel 37 is pressed against the bottom face 23*a* of the cross-member 23 and for another, the clamping part 41 is pressed against the clamping part 42 of the retaining panel 34 and against the side face 23*b* of the cross-member 23 to thus obtain a particularly reliable seat of the mounting bolt 9 on the cross-member 23. On the other side of the cross-member 23 there may be additionally provided a corresponding clamp 40 to also apply pressure on the cross-member 23 from the other side.

The flange 32 mounted on both ends of the cross-member 23 comprises holes 23 through which bolts are passed to thus connect the flange 32 with any of the sidewalls 3, 4.

The longitudinal members 31 are connected with the retaining panel 34 by means of bolts 44 and 45. Presently, the longitudinal members 31 are configured as C-profiles, each extending longitudinally from one cross-member 23 to the next cross-member 23. It is a considerable advantage of the screening machine 1 that each longitudinal member is connected with a mounting tie 9 or with a cross-member 23 at each of its ends 31*a* by way of two screwed connections 44, 46 and 45, 46. This permits a transfer of bending moments from one longitudinal member 31 to the next longitudinal member 31 and to the cross-members 23 so as to increase the vibratory rigidity.

The side faces 23*b* of each cross-member 23 are provided with wear protection devices 51 configured as wear protection panels clamped to mounting profiles 53. The mounting profiles 53 are clipped onto the threaded portions of the bolts 38 with their clipping portions 53*a*, serving for one as wear protection for the threaded portions of the bolts 38 and for another as profiles for other components and in particular lateral wear protection panels 51 to be clamped thereon. To this end the mounting profiles 53 comprise mushroom-shaped lugs 53*b* on each side to clamp the wear protection panels 51 on by means of mushroom-shaped grooves.

The top face 23*c* of the cross-members 23 is protected by means of upper wear protection panels 52 from knocks and shocks or a direct, abrasive attack by the bulk material. The longitudinal sides are provided at the upper wear protection panels 52 with protective side strips 52*a* protruding downwardly and overlapping the wear protection side panels 51 to safely keep bulk material falling down from above away from the hollow space 51*b* between wear protection side panels 51 and the cross-member 23.

The wear protection side panels 51, which are retained by clamps only, are effectively prohibited from slipping down by way of wider shoulders 37*a* at the counterpanel 37 which support the wear protection side panels 51 from beneath as necessary.

Both the wear protection side panels 51 and the upper wear protection side panels 52 are so received at the mounting ties that said mounting ties 9 fulfill a double function in a very advantageous way in that they support the screen lining through the longitudinal members 31 and reliably protect the cross-members 23 from abrasion. Moreover, fastening each longitudinal member to the mounting tie 9 with two bolts each at each of its ends 31*a* allows a bend-resistant connection of the longitudinal members 31 with one another and with the cross-members 23 which again contributes to the rigidity of the screening machine 1.

The screening machine illustrated in the exemplary embodiment allows a modular structure and a modular expansion of the screening machine, wherein the flexible mounting of the longitudinal members 31 to the cross-members 23 allows to select a variable screen width so as to allow employing screen lining systems of different manufacturers.

The invention claimed is:

1. A screening machine (1), in particular for screening bulk material and the like, comprising a housing (2) and at least two sidewalls (3, 4) at which at least one screen deck (5-7) is disposed, the screen deck (5-7) comprising cross-members (23) mounted on the sidewalls (3, 4) and longitudinal members (31) mounted on the cross-members (23) and receiving a screen lining (8) to be exchangeable, characterized in that the longitudinal members (31) are clamped to the cross-members (23) from two different directions by means of removable mounting ties (9).

2. The screening machine (1) according to claim 1, wherein the mounting tie (9) is mounted around and clamping the cross-member (23) and comprises connecting means (38), a counterpanel (37) and a retaining panel (34).

3. The screening machine (1) according to claim 1, wherein the cross-members (23) are rectangular in cross-section, comprising a bottom face (23*a*) and two side faces (23*b*).

4. The screening machine (1) according to claim 3, wherein the counterpanel (37) is pressed against a bottom face (23*a*) of the cross-member (23).

5. The screening machine (1) according to claim 1, wherein at least one connecting means (38) is provided with a clamp (40).

6. The screening machine (1) according to claim 1, wherein the clamp (40) is pressed against a side face (23*b*) of the cross-member (23).

7. The screening machine (1) according to claim 6, wherein the clamp (40) comprises two mating, inclined slideways (41, 42).

8. The screening machine (1) according to claim 1, wherein the connecting means (38) are configured as mounting bolts.

9. The screening machine (1) according to claim 1, wherein the bolt heads (39) or screw nuts bear against the counterpanel (37).

10. The screening machine (1) according to claim 1, wherein the lateral distance between two mounting ties (9) on a cross-member (23) is adjustable.

11. The screening machine (1) according to claim 1, wherein a wear protection device (43) is received between two mounting ties (9) of a cross-member (23).

12. The screening machine (1) according to claim 1, wherein a connecting means has a mounting profile disposed on it on which at least one add-on part can be mounted.

13. The screening machine (1) according to claim 12, wherein the mounting profile is configured such that the add-on part can be clamped thereon.

14. The screening machine (1) according to claim 12, wherein at least one add-on part is a wear protection device.

15. The screening machine (1) according to claim 12, wherein the counterpanel supports the mounting profile from beneath.

16. The screening machine (1) according to claim 1, wherein an add-on part can be mounted on the retaining panel (34).

17. The screening machine (1) according to claim 16, wherein at least one add-on part is a wear protection device.

18. The screening machine (1) according to claim 1, wherein the mounting points (14) of the cross-members (23) are arranged in a defined grid (15).

* * * * *